US006067907A

United States Patent [19]

Iwamoto et al.

[11] Patent Number: 6,067,907

[45] **Date of Patent: *May 30, 2000**

[54] FIXING DEVICE FOR WET TYPE MASTER SHEET MAKING APPARATUS FOR MAKING MASTER SHEET

[75] Inventors: Tamio Iwamoto; Seiji Matsuo; Masahiro Hayashi, all of Tokyo, Japan

[73] Assignee: Iwatsu Electric Co., Ltd., Japan

[ * ] Notice: This patent is subject to a terminal disclaimer.

[21] Appl. No.: 09/272,058

[22] Filed: Mar. 18, 1999

[30] Foreign Application Priority Data

Mar. 27, 1998 [JP] Japan ..... 10-100334

[51] Int. Cl.[7] ..... B41F 35/00

[52] U.S. Cl. ..... 101/423; 101/425

[58] Field of Search ..... 101/423, 425, 101/424

[56] References Cited

FOREIGN PATENT DOCUMENTS 10-254248 3/1997 Japan .
11-109684 4/1999 Japan .

*Primary Examiner*—John S. Hilten
*Assistant Examiner*—Anthony H. Nguyen
*Attorney, Agent, or Firm*—Paul & Paul

[57] ABSTRACT

A fixing device for a wet type master sheet making apparatus for making a master sheet has a heated panel for fixing and drying a developed image on the master sheet while the master sheet moves on the panel, and a cleaning web placed between a surface of the panel and the master sheet to absorb extra developing liquid on the master sheet while the master sheet moves on the panel. The fixing device has web winding means for winding the web to move the web along the surface of the panel, and actuating means for selectively actuating the winding means by one of manual and electrical operations. Therefore, the user can easily and quickly tension the cleaning web to make the cleaning web tightly contact the surface of the panel by manually actuating the winding means when the cleaning web is replaced.

5 Claims, 7 Drawing Sheets

FIXING DEVICE FOR WET TYPE MASTER SHEET MAKING APPARATUS FOR MAKING MASTER SHEET

BACKGROUND OF THE INVENTION

1. Field of the Invention

The present invention relates to a fixing device for a wet type master sheet making apparatus for making a master sheet, and particularly relates to an improvement to a device described in Japanese patent application Nos. 9-82074 and 9-289046.

2. Description of the Related Art

As is known in the prior art, in a wet type master sheet making apparatus for making a master sheet, an electrostatic latent image on the surface of the master sheet is developed by a developing liquid. After being developed, extra developing liquid is removed by a rinse squeezing device, and then a toner image is fixed and dried by a fixing device.

FIG. 7 shows the fixing device for the wet type master sheet making apparatus. The fixing device has a pre-heating panel heater B and a drying panel heater C on a fixing device frame, the pre-heating panel heater B and the drying panel heater C being aligned in the transporting direction of the master sheet X. The master sheet X is transported from the rinse squeezing device (not shown), and then transported by intermediate transporting rollers D and exit transporting rollers E. While the master sheet X is transported by the rollers D and E, the toner image on the surface of the master sheet X is fixed and dried. In FIG. 7, "F" shows pressure rollers for pressing the master sheet X toward the drying panel heater C.

In the fixing device shown in FIG. 7, the master sheet X which is transported from the rinse squeezing device includes moisture. Particularly, the back surface includes liquid including extra toner.

Therefore, when the master sheet X is pre-heated and dried by the pre-heating panel heater B and the drying panel heater C, the extra toner is transferred from the back surface of the master sheet X to the surface b of the heater B and the surface c of the heater C, and then a mass of the extra toner may deposit on the surfaces b and c.

If a mass of the extra toner is deposited on the surfaces b and c, the leading edge of the master sheet X may impact against the mass of the extra toner on the surfaces b and c. If the leading edge of the master sheet X impacts against the mass of the extra toner on the surfaces b and c, the maester sheet X may be jammed, or the mass of the extra toner may peel off from the surfaces b and c, and may be deposited on the surface or the back surface of the master sheet X. If the mass of the extra toner is deposited on the surface or the back surface of the master sheet X, the master sheet X is contaminated, or another master sheet adjoining the master sheet X on the stacker may be contaminated.

If the master sheet X is contaminated, a sheet to be printed is contaminated by the contaminated master sheet x when the sheet to be printed is offset printed.

In order to solve the above problem, a fixing device described in Japanese patent application No. 9-82074 has a cleaning web placed on the surface of the panel heater. The cleaning web is gradually fed in a direction opposite to the master sheet transporting direction, and absorbs the extra toner on the back surface of the master sheet. The cleaning web can prevent the back surface of the master sheet and the surface of the panel heater being contaminated. However, it is difficult to attach the cleaning web to the fixing device.

The cleaning web must be tensioned on the surface of the panel heater. When a new cleaning web replaces an old cleaning web, an electromagnetic solenoid is remote controlled to tension the cleaning web in an inching device described in Japanese patent application No. 9-82074.

However, it is troublesome to remote control the solenoid to tension the cleaning web. Further, it is difficult for a beginner to replace a cleaning web and to tense the cleaning web. In order to solve the above problem, a fixing device described in Japanese patent application No. 9-289046 is provided.

However, because the fixing device described in Japanese patent application No. 9-289046 has a pre-heating panel heater and a drying panel heater, the fixing device described in Japanese patent application No. 9-289046 cannot be applied to the small fixing device which has a cleaning web.

SUMMARY OF THE INVENTION

Therefore, an object of the present invention is to provide a small fixing device which can prevent the surface of the panel heater being contaminated by the extra toner, and can decrease the frequency of jamming of the master sheet, and in which a beginner can easily tension the new cleaning web.

Another object of the present invention is to provide a small fixing device wherein a cleaning web can be gradually fed in a constant rate in spite of a change in the diameter of the wound cleaning web.

The present invention provides a fixing device for a wet type master sheet making apparatus for making a master sheet, comprising:

a heated panel for fixing and drying a developed image on the master sheet while the master sheet moves on the panel;

a cleaning web placed between a surface of the panel and the master sheet to absorb extra developing liquid on the master sheet while the master sheet moves on the panel;

web winding means for winding the web to move the web along the surface of the panel; and actuating means for selectively actuating the winding means by one of manual and electrical operations.

Further, the present invention provides a fixing device for a wet type master sheet making apparatus for making a master sheet, comprising:

a heated panel for fixing and drying a developed image on the master sheet while the master sheet moves on the panel;

a cleaning web placed between a surface of the panel and the master sheet to absorb extra developing liquid on the master sheet while the master sheet moves on the panel, the cleaning web being supplied from an upstream bobbin and being wound to a downstream bobbin;

a shaft for supporting the downstream bobbin, the shaft having a grip adapted to be manually turned;

a solenoid for rotating the downstream bobbin to wind the cleaning web to the downstream bobbin;

a first one-way clutch for permitting the solenoid to rotate the downstream bobbin to wind the cleaning web to the downstream bobbin, and for preventing the solenoid from rotating the downstream bobbin to release the cleaning web from the downstream bobbin;

a second one-way clutch for permitting the grip to be turned to rotate the downstream bobbin to wind the cleaning web to the downstream bobbin, and for preventing the grip from being turned to rotate the downstream bobbin to release the cleaning web from the downstream bobbin; and wherein the cleaning web covering the surface of the panel can be tensioned by manually turning the grip, in order to make the cleaning web tightly contact the surface of the panel.

The fixing device for a wet type master sheet making apparatus for making a master sheet can easily and quickly tension the cleaning web by manually rotating the winding shaft when the cleaning web is replaced.

Preferably, the grip projects toward the front side of the fixing device.

Preferably, the second one-way clutch is interposed between the shaft and a mounting bracket mounted to a frame, the frame supporting the shaft.

Preferably, the fixing device further comprises;

an intermediate roller interposed between the upstream bobbin and the panel for guiding the cleaning web extending from the upstream bobbin to the panel;

a torque limiter for preventing all of the torque of the shaft from being transferred to the downstream bobbin when the diameter of the cleaning web wound to the downstream bobbin is large;

a drive pulley attached to the shaft;

a follower pulley connected to the intermediate roller;

a timing belt for connecting the drive pulley and the follower pulley; and wherein the cleaning web is always fed at a constant rate by the solenoid from the upstream bobbin to the surface of the panel, in spite of the change of the diameter of the cleaning web wound to the downstream bobbin.

The fixing device can gradually feed the cleaning web in a constant rate by intermittently exciting the electromagnetic solenoid in spite of the change of the diameter of the upstream cleaning web to be wound or the downstream wound cleaning web.

BRIEF DESCRIPTION OF THE DRAWINGS

The above and other objects, features and advantages of the present invention will be made more apparent from the following description of the preferred embodiments thereof in conjunction with the accompanying drawings wherein.

DESCRIPTION OF THE PREFERRED EMBODIMENTS

Figure 1:
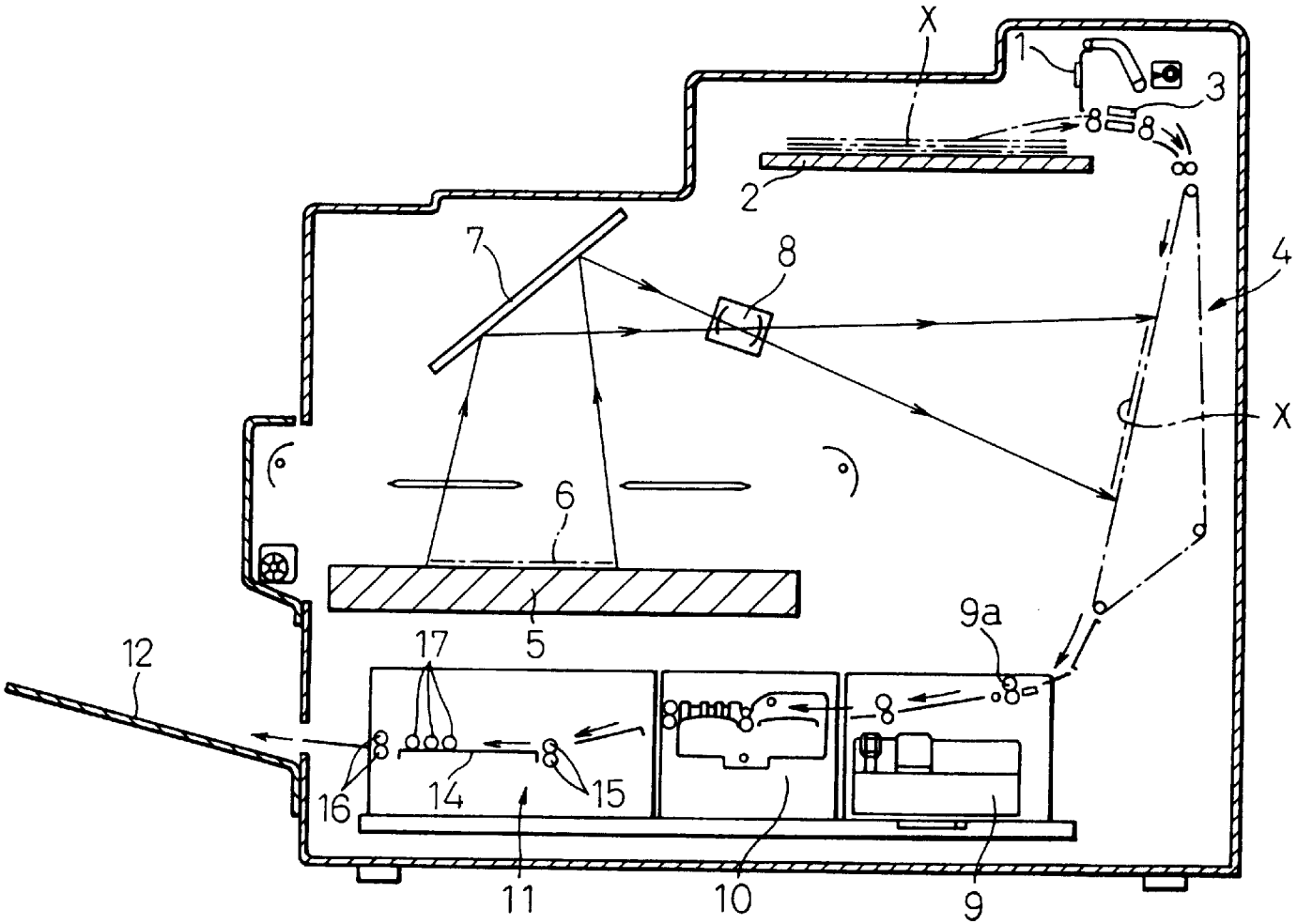
FIG. 1 is a partial cross sectional side view of a wet type aster sheet making apparatus for making a master sheet including a fixing device of the first embodiment of the present invention.

FIG. 1 shows a partial cross sectional side view of a wet type master sheet making apparatus for making a master sheet including a fixing device of the first embodiment of the present invention. In FIG. 1, a master sheet X is fed one by one from a master sheet supporting portion 2 by a vacuum suction head 1, and passed through a charger 3, and then transported to an exposing stage 4. The master sheet X is stopped and held at the exposing stage 4, and then an electrostatic latent image is formed on the master sheet X by a mirror 7 and a lense 8, the electrostatic latent image being based on an original 6 which is supported on an original supporting portion 5.

The electrostatic latent image on the master sheet X is then developed by a developer 9 having a developing liquid spray 9*a*. The developed image on the master sheet X is then transported to a rinse squeezing device 10 and an extra developing liquid on the master sheet X is removed. Then, the master sheet X is transported to a fixing device 11 to fix and dry a toner image on the master sheet X. After being fixed and dried, the master sheet X exits onto an exit tray 12.

Figure 2:
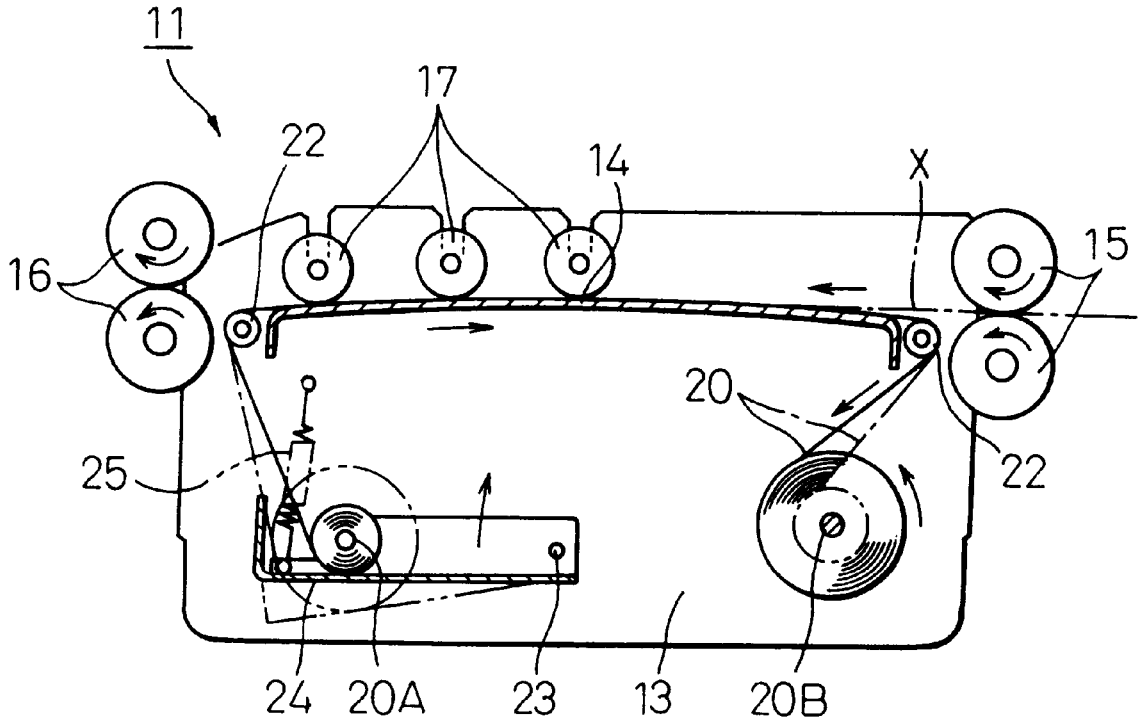
FIG. 2 is a partial cross sectional side view of the fixing device of the first embodiment of the present invention.

FIG. 2 shows a partial cross sectional side view of the fixing device 11 of the first embodiment of the present invention. As shown in FIG. 2, a frame 13 of the fixing device 11 supports a drying and fixing panel heater 14. When the master sheet X is passed through the panel heater 14, the panel heater 14 adjoins the master sheet X, that is, the panel heater 14 is aligned in a transporting direction of the master sheet X. The panel heater 14 has an electric heater element (not shown), and the master sheet X is dried and fixed by the heater element.

Further, the frame 13 supports entrance transporting rollers 15 for feeding the master sheet X onto the panel heater 14, and exit transporting rollers 16 for feeding the dried master sheet X from the panel heater 14. The master sheet X is transported from the right side (upstream side) to the left side (downstream side) along a horizontal arrow by rollers 15 and 16. A plurality of pressure rollers 17 are mounted on a downstream side area of the surface of the panel heater 14. The back surface of the master sheet X is pressed toward the surface of the panel heater 14 by the pressure rollers 17 and is dried by the panel heater 14.

In this embodiment, the surface of the panel heater 14 is covered with a cleaning web 20, the cleaning web 20 being gradually fed in a direction opposite to the master sheet transporting direction. The width of the cleaning web 20 is the same as the width of the panel heater 14. The cleaning web 20 is very thin and has heat resistance, and is comprised of non-woven fabric, such as combined aramide/polyester woven cloth, or glass wool fiber. The cleaning web 20 is supplied from an upstream bobbin 20A mounted under the downstream side area of the surface of the panel heater 14. The cleaning web 20 has been pre-wound onto the bobbin 20A.

After the cleaning web 20 is supplied from the bobbin 20A, the cleaning web 20 moves along the surface of the panel heater 14, and then is wound to a downstream bobbin 20B mounted under an upstream side area of the surface of the panel heater 14.

In order to make the cleaning web 20 tightly contact the curved surface of the panel heater 14, guide rollers 22 respectively mounted at the upstream and downstream ends of the panel heater 14 are aligned parallel to the surface of the panel heater 14, so that the corrugation of the cleaning web 20 is prevented.

A brake shoe 24 is pressed against the cleaning web 20 wound to the bobbin 20A, the brake shoe 24 being pivotable around a shaft 23 supported by the frame 13. A tension spring 25 is attached to a tip end of the brake shoe 24 in order to press a middle portion of the brake shoe 24 against the cleaning web 20 wound to the bobbin 20A so that extra feeding of the cleaning web 20 is prevented.

Figure 3:
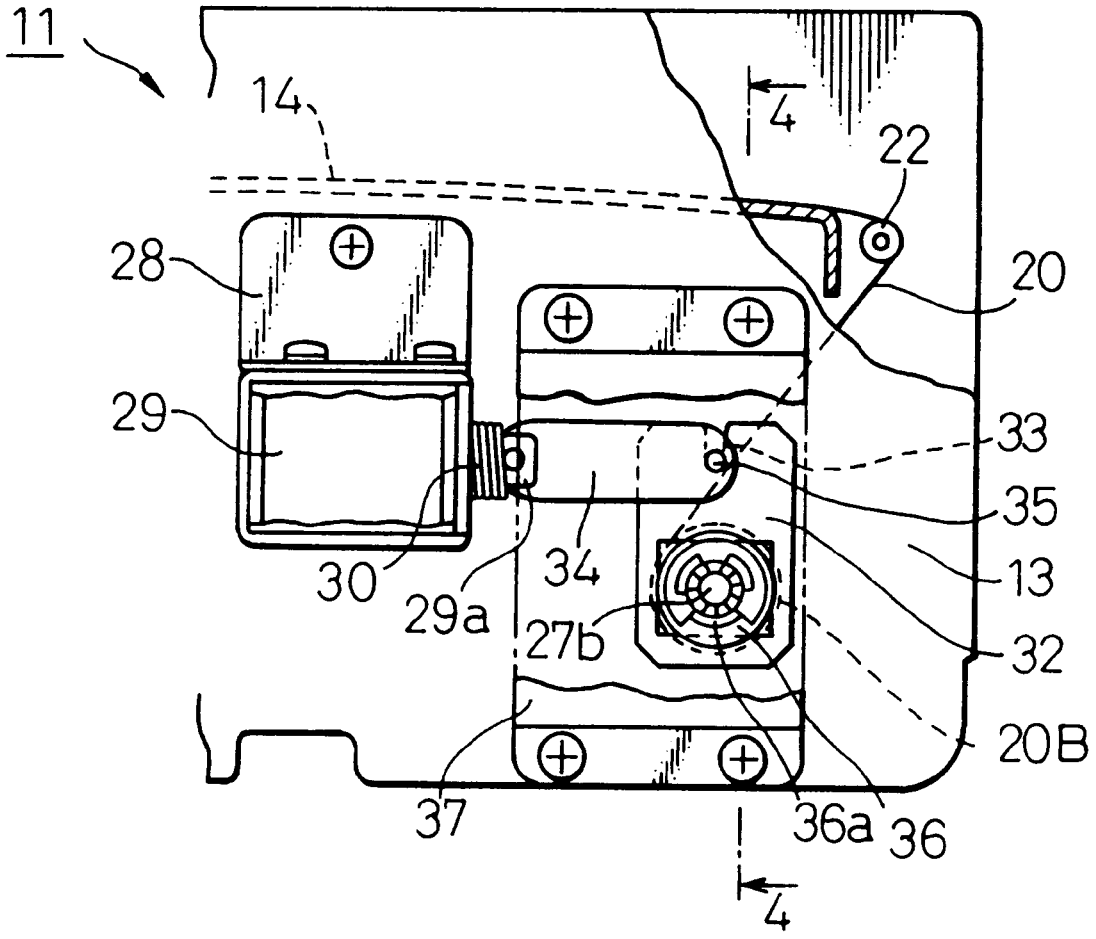
FIG. 3 is a detailed and broken view of the fixing device of the first embodiment of the present invention.
Figure 4:
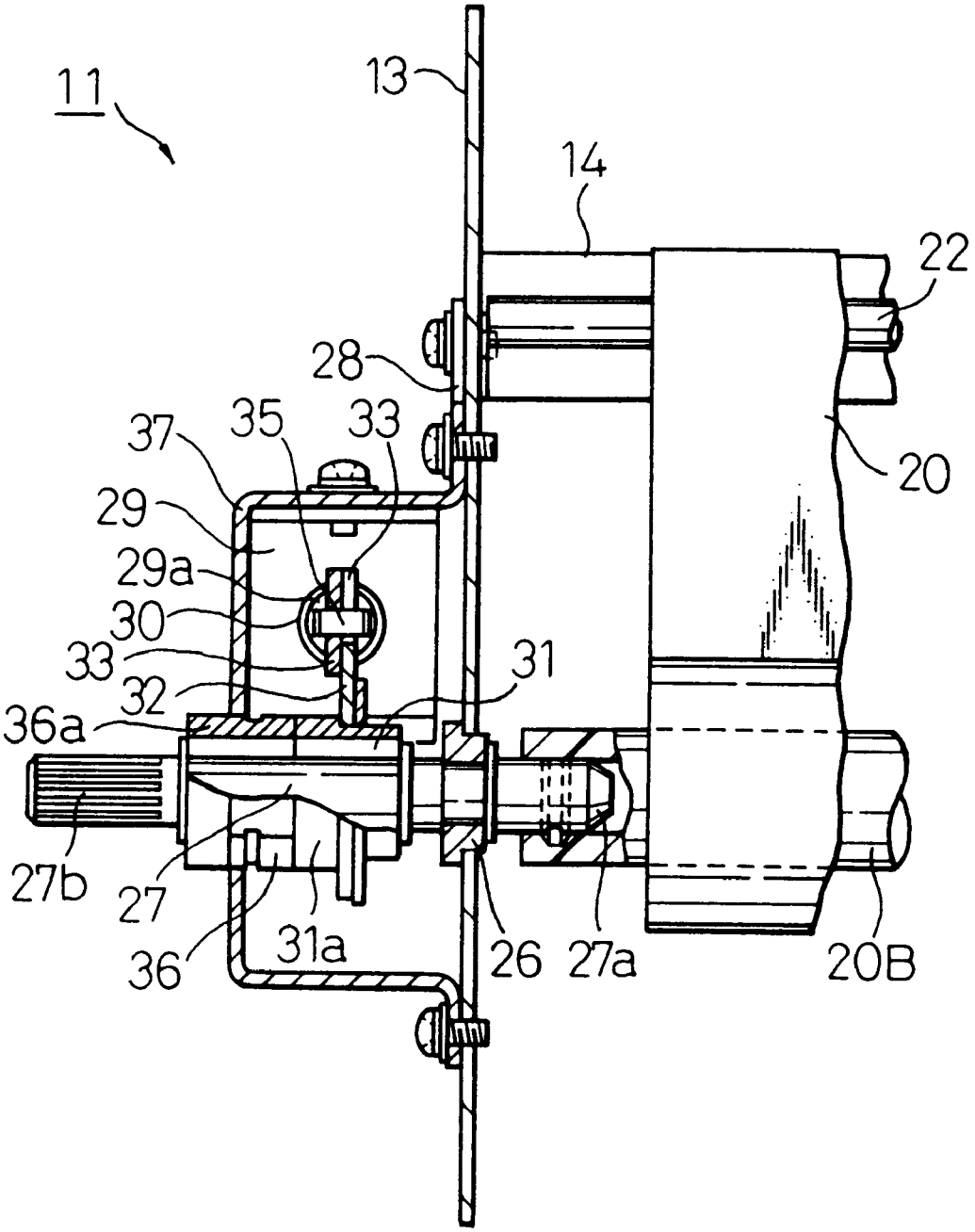
FIG. 4 is a cross sectional view taken along line IV—IV in FIG. 3.

FIG. 3 shows a detailed and broken view of the fixing device of the first embodiment of the present invention, and FIG. 4 shows a cross sectional view taken along line IV—IV in FIG. 3. In FIGS. 3 and 4, a web winding mechanism for winding the cleaning web 20 to the bobbin 20B is shown. The web winding mechanism has a rotatable winding shaft 27 held by a bearing 26 supported by the frame 13. The shaft 27 has an attachment end 27*a* attached to the bobbin 20B, to which the cleaning web 20 is wound. The shaft 27 has a grip 27*b* which projects toward the front side of the frame 13. When a new cleaning web 20 is replaced, the cleaning web 20 is wound to the bobbin 20B by manually turning the grip 27*b* counterclockwise (FIG. 3).

An electromagnetic solenoid 29 is mounted on the frame 13 via a mounting bracket 28. The electromagnetic solenoid 29 can be excited on the basis of electrical signals. A plunger 29*a* of the solenoid 29 is pressed to the right side (FIG. 3) by a compression spring 30. As shown in FIG. 4, a clutch sleeve 31*a* is attached to a middle portion of the shaft 27 via a first one-way clutch 31. The first one-way clutch 31 does not transfer the clockwise rotational movement of the clutch sleeve 31*a* to the shaft, but transfers the counterclockwise rotational movement of the clutch sleeve 31*a* to the shaft 27. A rotational member 32 is attached to the clutch sleeve 31*a*. A connecting groove 33 of the rotational member 32 engages with a drive pin 35 of a connecting member 34, the connecting member 34 being connected to the tip of the plunger 29*a*.

When the solenoid 29 is excited to pull the plunger 29*a* to the left (FIG. 3) against the compression spring 30, the connecting member 34 makes the rotational member 32 and the clutch sleeve 31*a* rotate through a predetermined angle around the shaft 27, so that the rotational movement of the rotational member 32 is transferred to the shaft 27 via the first one-way clutch 31.

A second one-way clutch 36 is mounted to the middle portion of the shaft 27 to adjoin the first one-way clutch 31. The second one-way clutch 36 allows the shaft to rotate only counterclockwise (FIG. 3). A clutch sleeve 36*a* of the second one-way clutch 36 is attached to a mounting bracket 37 which is mounted to the frame 13.

Because the second one-way clutch 36 is provided, even when the solenoid 29 is not excited to rotate the shaft 27 via the first one-way clutch 31, the shaft 27 can be rotated by manually turning the grip 27*b*, therefore, the bobbin 20B can be rotated counterclockwise (FIG. 3) so that, when a new cleaning web 20 is set in the fixing device, the cleaning web can be easily and quickly tensioned to tightly contact the panel heater 14.

As explained above, when the solenoid 29 is intermittently excited, the cleaning web 20 is gradually fed in the direction opposite to the transporting direction of the master sheet X, therefore, the contaminated cleaning web 20 is wound to the bobbin 20B so that, the cleaning web 20 on the surface of the panel heater 14 is always kept clean.

Further, when a cleaning web 20 is replaced, the end of the new cleaning web 20 extending from the bobbin 20A is passed through the surface of the panel heater 14, and is attached to the bobbin 20B supported by the shaft 27. While being replaced, the new cleaning web 20 can be easily and quickly tensioned. That is, after the tip end of the new cleaning web 20 is attached to the bobbin 20B, the grip 27*b* of the shaft 27 is manually turned counterclockwise (FIG. 2) to tension the new cleaning web 20, the new cleaning web 20 tightly contacting the surface of the panel heater 14.

In other words, even if the tip end of the new cleaning web 20 is attached to the bobbin 20B, unless the new cleaning web 20 is tensioned, the tip end of the master sheet X may be jammed on the panel heater 14 because of the corrugation of the new cleaning web 20. However, in this embodiment, because the new cleaning web 20 is tensioned by manually turning the grip 27*b* of the shaft 27, jamming of the tip end of the master sheet X can be prevented. Further, it is very easy for not only an expert but also a beginner to replace a cleaning web and to manually turn the grip 27*b* of the shaft 27 to tension the new cleaning web 20.

Figure 5:
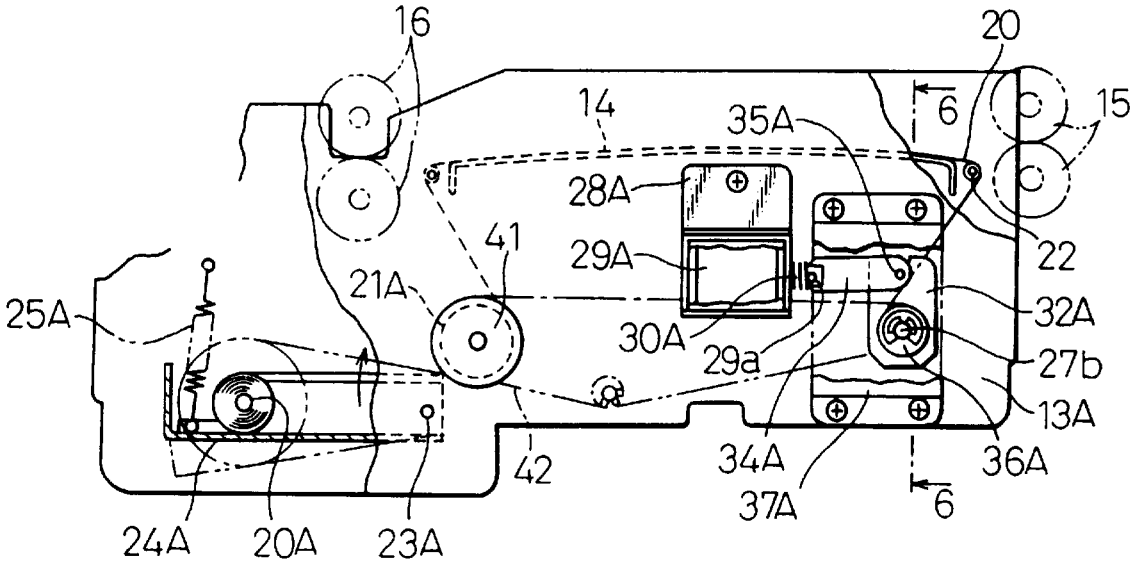
FIG. 5 is a detailed and broken view of the fixing device of the second embodiment of the present invention.
Figure 6:
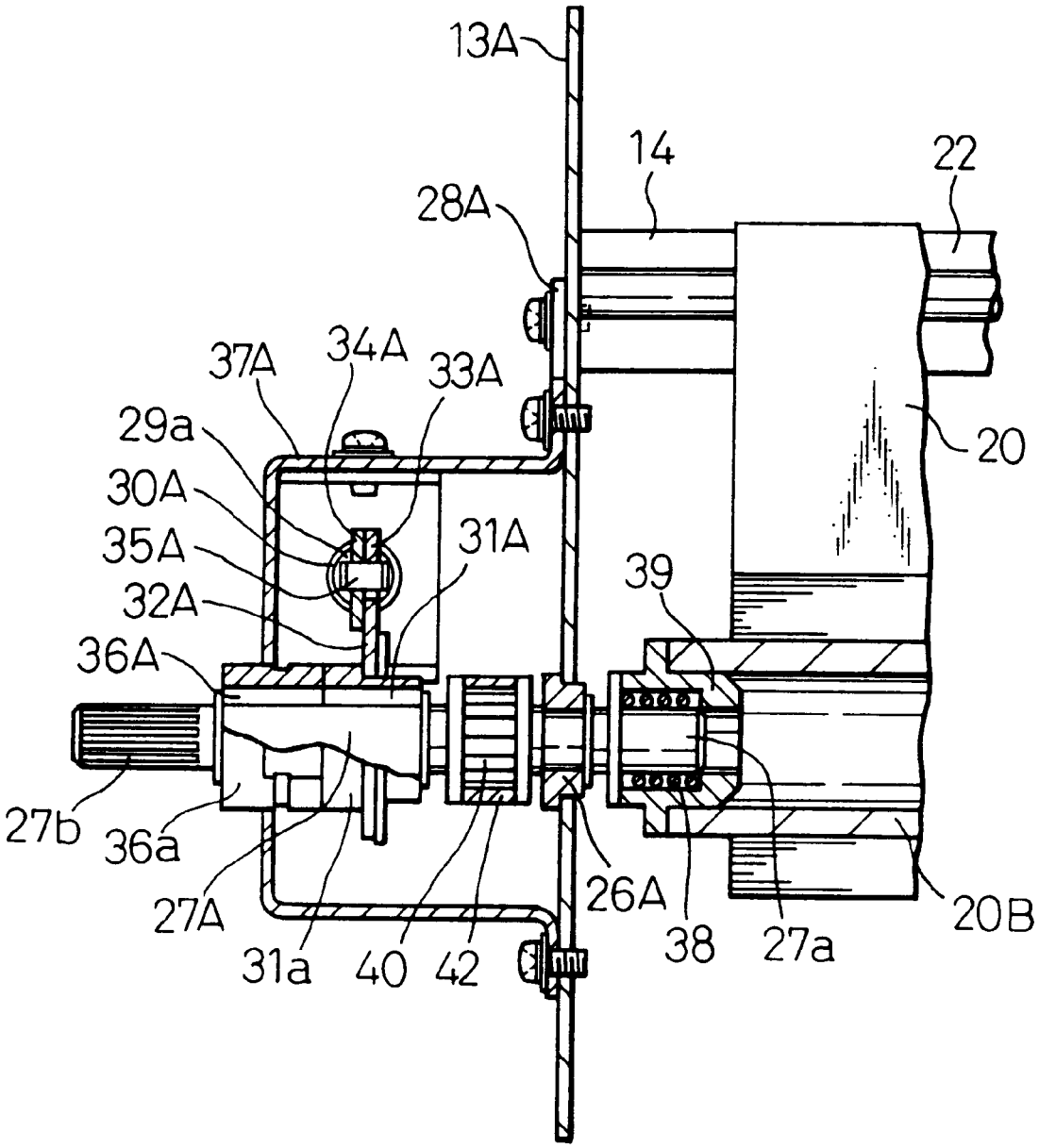
FIG. 6 is a cross sectional view taken along line VI—VI in FIG. 5.
Figure 7:
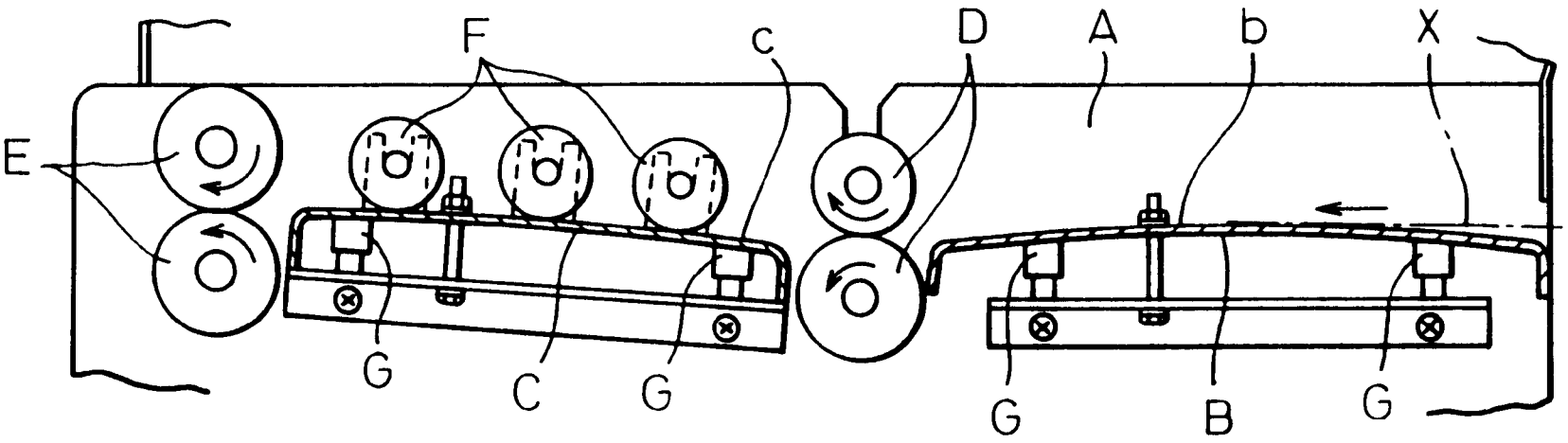
Fig. 7 (PRIOR ART)
FIG. 7 is a partial cross sectional side view of the fixing device of the prior art.

FIG. 5 shows a detailed and broken view of the fixing device 11A of the second embodiment of the present invention, and FIG. 6 shows a cross sectional view taken along line VI—VI in FIG. 5. In this embodiment, when a solenoid 29A is periodically excited, a cleaning web 20 is fed at a constant rate, in spite of the change of the diameter of the cleaning web wound onto a downstream bobbin 20B.

A brake shoe 24A is pressed against the cleaning web 20 wound to an upstream bobbin 20A, the brake shoe 24A being pivotable around a shaft 23A supported by a frame 13A. A tension spring 25A is attached to a tip end of the brake shoe 24A in order to press a middle portion of the brake shoe 24A against the cleaning web 20 wound to the bobbin 20A so that extra feeding of the cleaning web 20 is prevented.

A web winding mechanism of this embodiment has a rotatable winding shaft 27A held by a bearing 26A supported by the frame 13A.

In this embodiment, a bobbin side end 27*a* of the shaft 27A is attached to the bobbin 20B via a torque limiter 38 and a cylindrical bobbin receiver 39.

The shaft 27A has a grip 27*b* which projects toward the front side of the frame 13A. When a cleaning web 20 is replaced, the new cleaning web 20 is wound to the bobbin 20B by manually turning the grip 27*b* counterclockwise (FIG. 5).

An electromagnetic solenoid 29A is mounted on the frame 13A by a mounting bracket 28A. The electromagnetic solenoid 29A can be excited on the basis of electrical signals. A plunger 29*a* of the solenoid 29A is pressed to the right side (FIG. 5) by a compression spring 30A.

As shown in FIG. 6, a clutch sleeve 31*a* is attached to a middle portion of the shaft 27A via a first one-way clutch 31A. The first one-way clutch 31A does not transfer the clockwise rotational movement of the clutch sleeve 31*a* to the shaft 27A, but transfers the counterclockwise rotational movement of the clutch sleeve 31*a* to the shaft 27A. A rotational member 32A is attached to the clutch sleeve 31*a*. A connecting groove 33A of the rotational member 32A engages with a drive pin 35A of a connecting member 34A, the connecting member 34A being connected to the tip of the plunger 29*a*.

When the solenoid 29A is excited to pull the plunger 29*a* to the left (FIG. 5) against the compression spring 30A, the connecting member 34A makes the rotational member 32A and the clutch sleeve 31*a* rotate through a predetermined angle around the shaft 27A, so that the rotational movement of the rotational member 32A is transferred to the shaft 27A via the first one-way clutch 31A. However, in this embodiment, because the torque limiter 38 is interposed between the shaft 27A and the bobbin receiver 39, the torque of the shaft 27A which is equal to or larger than a predetermined torque is not transferred to the bobbin 20B, but the torque of the shaft 27A which is smaller than the predetermined torque is transferred to the bobbin 20B.

A second one-way clutch 36A is mounted to the middle portion of the shaft 27A to adjoin the first one-way clutch 31A. The second one-way clutch 36A allows the shaft 27A to rotate only counterclockwise (FIG. 5). A clutch sleeve 36*a* of the second one-way clutch 36A is attached to the a mounting bracket 37A which is mounted to the frame 13A.

Because the second one-way clutch 36A is provided, even when the solenoid 29A is not excited to rotate the shaft 27A via the first one-way clutch 31A, the shaft 27A can be rotated by manually turning the grip 27*b*, therefore, the bobbin 20B can be rotated counterclockwise (FIG. 5) so that, when a new cleaning web 20 is set in the fixing device, the cleaning web 20 can be easily and quickly tensioned to tightly contact the panel heater 14.

A drive pulley 40 is attached to the middle portion of the shaft 27A. A follower pulley 41 is attached to a shaft of an intermediate roller 21A. The diameter of the drive pulley 40 is smaller than the diameter of the follower pulley 41. The drive pulley 40 and the follower pulley 41 are connected by a timing belt 42. When the shaft 27A and the drive pulley 40 are intermittently rotated, the intermediate roller 21A is intermittently rotated counterclockwise (FIG. 5) at a reduced rate by the timing belt 42 and the follower pulley 41.

As explained above, when a cleaning web 20 is replaced, the tip end of the new cleaning web 20 extending from the bobbin 20A is passed through the intermediate roller 21A and the surface of the panel heater 14, and is attached to the bobbin 20B supported by the shaft 27A. While being replaced, the new cleaning web 20 can be easily and quickly tensioned. That is, after the tip end of the new cleaning web 20 is attached to the bobbin 20B, the grip 27*b* of the shaft 27A is manually turned counterclockwise (FIG. 2) to tension the new cleaning web 20, the new cleaning web 20 tightly contacting the surface of the panel heater 14.

When the solenoid 29A is intermittently excited during the operation of the fixing device, the movement of the plunger 29*a* of the solenoid 29A is transferred to the bobbin receiver 39 and the drive pulley 40 via the first one-way clutch 31A. Then, the counterclockwise rotational movement of the drive pulley 40 is transferred to the intermediate roller 21A via the timing belt 42 and the follower pulley 41. The intermittent rotational movement of the intermediate roller 21A at a reduced rate helps the cleaning web 20 to be intermittently fed at a predetermined rate toward the downstream bobbin 20B.

When the diameter of the cleaning web 20 wound to the downstream bobbin 20B is large, that is, when the torque of the downstream bobbin 20B is larger than a limited torque of the torque limiter 38, the rotational movement of the shaft 27A is not completely transferred to the downstream bobbin 20B. Therefore, the downstream bobbin 20B is rotated by the shaft 27A while being influenced by the rotation of the intermediate roller 21A. Further, because the rotational speed of the intermediate roller 21A is determined by the drive pulley 40 and the follower pulley 41, the rotational speed of the intermediate roller 21A is constant when the solenoid 29A is excited.

In this embodiment, the torque limiter 38 and the intermediate roller 21A are provided. The intermediate roller 21A rotates at a constant rate when the intermediate roller 21A is driven by the solenoid 29A. Therefore, the cleaning web 20 is always fed at a constant rate to the surface of the panel heater 14, in spite of the change of the diameter of the cleaning web which is pre-wound to the upstream bobbin 20A or the change of the diameter of the cleaning web wound to the downstream bobbin 20B so that, the cleaning web 20 on the surface of the panel heater 14 is always kept clean.

While the above description constitutes the preferred embodiment of the present invention, it will be appreciated that the invention is susceptible to modification, variation and change without departing from the proper scope and fair meaning of the accompanying claims.

What is claimed is:

1. A fixing device for a wet type master sheet making apparatus for making a master sheet, comprising:

a heated panel for fixing and drying a developed image on the master sheet while the master sheet moves on the panel;

a cleaning web placed between a surface of the panel and the master sheet to absorb extra developing liquid on the master sheet while the master sheet moves on the panel;

web winding means for winding the web to move the web along the surface of the panel; and actuating means for selectively actuating the winding means by one of manual and electrical operations.

2. A fixing device for a wet type master sheet making apparatus for making a master sheet, comprising:

a heated panel for fixing and drying a developed image on the master sheet while the master sheet moves on the panel;

a cleaning web placed between a surface of the panel and the master sheet to absorb extra developing liquid on the master sheet while the master sheet moves on the panel, the cleaning web being supplied from an upstream bobbin and being wound to a downstream bobbin;

a shaft for supporting the downstream bobbin, the shaft having a grip adapted to be manually turned;

a solenoid for rotating the downstream bobbin to wind the cleaning web to the downstream bobbin;

a first one-way clutch for permitting the solenoid to rotate the downstream bobbin to wind the cleaning web to the downstream bobbin, and for preventing the solenoid from rotating the downstream bobbin to release the cleaning web from the downstream bobbin;

a second one-way clutch for permitting the grip to be turned to rotate the downstream bobbin to wind the cleaning web to the downstream bobbin, and for preventing the grip from being turned to rotate the downstream bobbin to release the cleaning web from the downstream bobbin; and wherein the cleaning web covering the surface of the panel can be tensioned by manually turning the grip, in order to make the cleaning web tightly contact the surface of the panel.

3. A fixing device according to claim 2, wherein the grip projects toward the front side of the fixing device.

4. A fixing device according to claim 2, wherein the second one-way clutch is interposed between the shaft and a mounting bracket mounted to a frame, the frame supporting the shaft.

5. A fixing device according to claim 2, further comprising;

an intermediate roller interposed between the upstream bobbin and the panel for guiding the cleaning web extending from the upstream bobbin to the panel;

a torque limiter for preventing all of the torque of the shaft from being transferred to the downstream bobbin when the diameter of the cleaning web wound onto the downstream bobbin is large;

a drive pulley attached to the shaft;

a follower pulley connected to the intermediate roller;

a timing belt for connecting the drive pulley and the follower pulley; and wherein the cleaning web is always fed at a constant rate by the solenoid from the upstream bobbin to the surface of the panel, in spite of the change of the diameter of the cleaning web wound onto the downstream bobbin.

* * * * *